US005172814A

United States Patent [19]

Pell et al.

[11] Patent Number: 5,172,814

[45] Date of Patent: Dec. 22, 1992

[54] JEWELRY BOARD

[75] Inventors: Carol C. Pell; Pamela J. Simon, both of Wilmette, Ill.

[73] Assignee: Other Notions, Inc., Skokie, Ill.

[21] Appl. No.: 799,688

[22] Filed: Nov. 22, 1991

[51] Int. Cl.[5] ..... A47F 7/00

[52] U.S. Cl. ..... 211/13; 211/87; 211/57.1

[58] Field of Search ..... 211/13, 70, 87, 90, 211/57.1; 206/486, 487

[56] References Cited

U.S. PATENT DOCUMENTS

| | | | |
|---|---|---|---|
| 2,559,289 | 7/1951 | Eisen et al. . | |
| 2,769,553 | 11/1956 | Horton . | |
| 2,942,364 | 6/1960 | Horton . | |
| 3,027,017 | 3/1962 | Luxeder . | |
| 3,495,717 | 2/1970 | Lavin et al. . | |
| 3,930,702 | 1/1976 | Pichowicz . | |
| 3,944,176 | 3/1976 | Danko . | |
| 3,997,050 | 12/1976 | Patterson . | |
| 4,014,438 | 3/1977 | O'Toole et al. . | |
| 4,141,453 | 2/1979 | Hanan | 211/13 |
| 4,181,224 | 1/1980 | Aber | 211/13 X |
| 4,264,013 | 4/1981 | Vollmer | 211/13 |
| 4,324,446 | 4/1982 | LeSage . | |
| 4,372,450 | 2/1983 | Licari et al. . | |
| 4,401,219 | 8/1983 | Mink . | |
| 4,420,084 | 12/1983 | Whelan . | |
| 4,465,179 | 8/1984 | Miller . | |
| 4,546,888 | 10/1985 | Rosberg et al. . | |
| 4,573,585 | 3/1986 | Frei | 211/13 |
| 4,662,592 | 5/1987 | Garfinkle . | |
| 4,720,012 | 1/1988 | Dufour . | |
| 4,776,650 | 10/1988 | Ferenzi | 211/13 |

*Primary Examiner*—Alvin C. Chin-Shue
*Assistant Examiner*—Sarah A. Lechok
*Attorney, Agent, or Firm*—Michael, Best & Friedrich

[57] ABSTRACT

A board for holding and displaying jewelry consisting of a base and a plurality of removable and replaceable jewelry holding brackets adapted to support on an individual basis clip type earrings, earrings for pierced ears, bracelets, necklaces, finger rings and pins. A special holder for supporting hair barrettes, such as used by little girls, is also adapted to be included or utilized with the board. The particular number of each type of support unit and their arrangement thereon can be determined by the user. Each of the elements for holding jewelry with the exception of an included pin pad and a shelf for supporting finger rings, can be removed and replaced on an as-desired basis.

18 Claims, 2 Drawing Sheets

JEWELRY BOARD

BACKGROUND OF THE INVENTION

1. Field of the Invention

This invention relates to jewelry storage means and more particularly to a board useful for the holding, displaying and organizing articles of jewelry.

2. Background Art

Wearers of jewelry have found out that the placement of such items as chains, necklaces, earrings, pendants, charms, etc., when placed in a drawer or jewelry box usually become mixed up and tangled, providing a particular problem in the ability to readily locate particular items of jewelry when they are desired to be worn. Currently, in the usual arrangement they become easily knotted or tangled and damage frequently results during the untangling process.

Some prior art arrangements have provided improvement in the hanging or supporting of jewelry articles but they still frequently suffer from the problems of tangling or knotting as noted above. Such devices are included in U.S. Pat. Nos. 3,997,050 which issued on Dec. 14, 1976, 4,324,446 which issued on Apr. 13, 1982, 4,401,219 which issued on Aug. 30, 1983, and 4,465,179 which issued on Aug. 14, 1984. Some of the devices covered by these patents are adaptable only to certain forms of jewelry, such as pierced ear type earrings, while others are not particularly efficient in keeping the various types of jewelry appropriately separated. Some of the prior art devices also suffer from other disadvantages, including a lack of adaptability to provide the necessary ease of access, reception and removal and instant visibility of the necessary articles of jewelry. Accordingly, it is the desire of this invention to provide a jewelry board which facilitates receiving, storing, displaying and organizing items of jewelry.

SUMMARY OF THE INVENTION

The present invention consists of a board, including a base usually manufactured of plastic but obviously adaptable to other materials, which normally finds its greatest usage in being rectangular in form. However, it should be noted that other configurations such as round, oval, octagonal, triangular, etc., could be utilized, although they may not be as efficient in utilization of space as with the conventional rectangular form.

The base has included therein a recessed area in which a pin pad, consisting of a resilient foamlike material, is placed in order to receive sharp pointed items, such as pins, etc., for storage and display purposes.

Located also on the front surface is a shelf in which a foam insert is included. The insert itself includes a number of slots adapted to receive and grip finger rings while displaying them in a convenient manner.

A number of other jewelry supporting devices project from the front surface of the jewelry board of the present invention, each by means of one or more removable type jewelry holding fixtures. Such removability facilitates the placement of the particular jewelry holders at different locations upon the front surface of the jewelry board of the present invention. Also different combinations of holders may be utilized depending upon the requirements of the user. For example, these holders may include special facilities for holding pierced earrings which may consist of holders equipped with a plurality of earrings extending through the front portion thereof so that pierced ear type earrings may be placed through the openings and held securely in place by the usual fasteners associated with such earrings.

Another type of holder especially adapted to support clipped earrings provides large openings in the holders so that the clips associated with such earrings can easily be slid over the edge portions of the holder allowing the earrings mounted thereon to be readily available and distinguishable. Holders for bracelets are substantially rectangular in form but have the upper portion thereof scalloped to provide a gripping surface so any bracelets mounted thereon are retained rather than easily being slid off of the supporting holder. Likewise, those holders especially adapted for necklaces are scalloped on top and bottom surfaces for similar reasons as outlined above in connection with the bracelet bar holders.

All of the holders of the present arrangement are substantially arcuate in form if viewed in cross section and are fastened to strutlike members with locking ends thereon adapted to be placed into openings in the base described above. An important facet of the present invention is that the various holders for earrings, bracelets, etc., can be readily removed or rearranged according to the particular needs and desires of the user. While it is envisioned that such holders will be primarily made of plastic, obviously it is also possible that they could be constructed of metallic materials, wood, ceramic or other materials.

To facilitate the mounting of the entire board to a wall or door, a T-slot mounting bracket is affixed to each of the corners so the board can be easily mounted by merely hooking over parallel spaced nails or screws or similar fasteners. The arrangement shown is quite stable and facilitates the board being able to support many items of jewelry.

An alternate form of holder is specially adapted to be able to hold barrettes or similar devices such as are frequently used by younger children and can be placed on the board to replace two of the more conventional jewelry holder devices described above.

DETAILED DESCRIPTION OF THE PREFERRED EMBODIMENT

Figure 1:
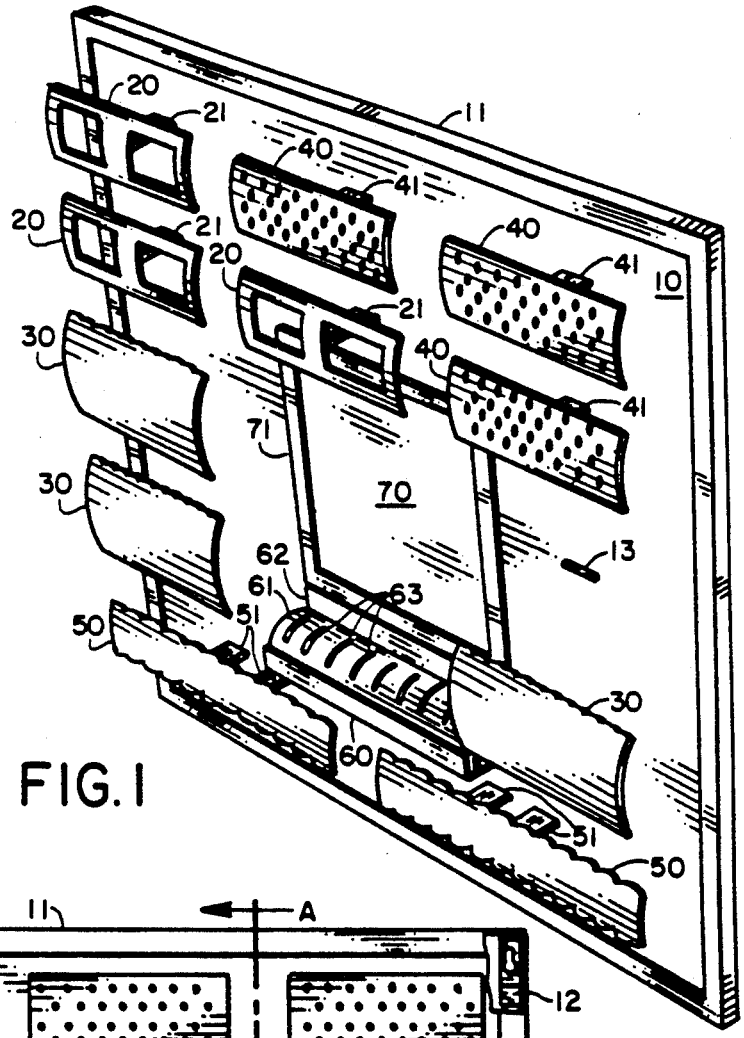
FIG. 1 is a perspective view of a jewelry board in accordance with the present invention showing a number of different kinds of jewelry holders affixed to the base.
Figure 2:
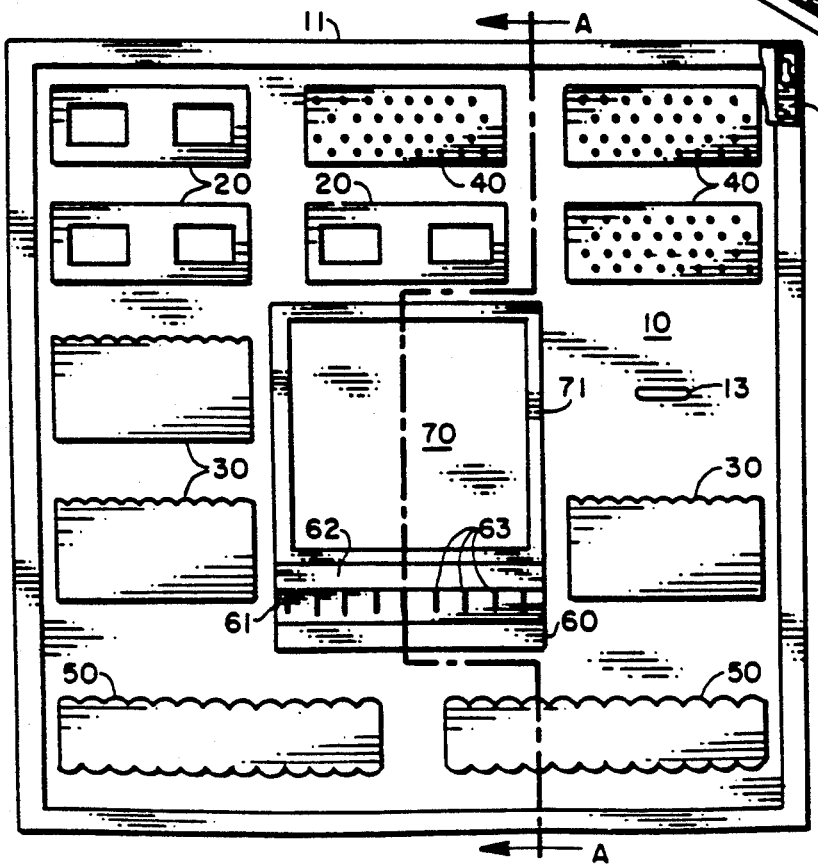
FIG. 2 is a front view of a jewelry board in accordance with the present invention.
Figure 3:
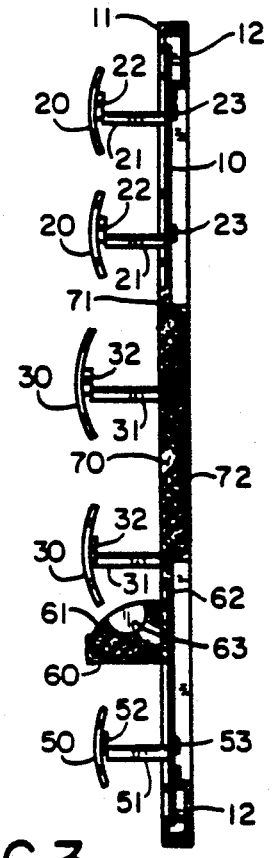
FIG. 3 is a side view of a jewelry board in accordance with the present invention, taken along section lines A—A of FIG. 2.

Referring now to FIGS. 1, 2, and 3, a base 10 of the jewelry board of the present invention can be configured in many versions, although it is shown in the present drawings as essentially a square configuration. It will be obvious that many other shapes—rectangular, triangular, octangular, round, etc., could be utilized and still fall within the terms and considerations of the present invention.

The base unit as shown is envisioned as being constructed of plastic but obviously could also be constructed of metal, wood, or even of ceramic material. Even certain stiffened paper products might also be adaptable for this purpose. As may be seen by reference to the previously noted drawings, the base is surrounded by an integral frame portion 11 and has a T-slot bracket 12 mounted at each of the corners which facilitate its being mounted onto a wall, door, etc. The T-slot mounting brackets, such as 12, can be made of metal or plastic and may be integral or affixed by means of epoxy or similar cementing materials to the rear of the base 10. Spaced throughout the base are a plurality of openings 13 which facilitate the placement of the various jewelry supporting assemblies 20, 30, 40, and 50. These openings are so spaced so that mounting tabs, that are part of each of the accessory support units, can be placed through and locked in place and provide the necessary support for the accessory assemblies.

Accessory assemblies 20 are of rectangular configuration with two large rectangular openings therein and have affixed to the rear thereof a reinforced angle bracket 21 having a large tab portion 22 at the front of each which is fastened to the rear of the clip earring support portion of the assembly and having a vertical locking rear section 23 at the rear of each mounting bracket which extends through an opening 13, with the vertical portion being in contact with the rear of base 10 providing the necessary support for the assembly 20. A number of accessory assemblies for clip earrings, like 20, are shown, but it should be understood that the particular location is not necessarily as shown in FIGS. 1, 2, and 3. In fact, all of the various accessory assemblies (except those for necklaces) can be repositioned within any of the openings 13 throughout the entire base so as to best meet the requirements or wishes of the individual user.

An accessory assembly particularly designed for the support of bracelets, is like that shown as item 30, essentially being rectangular and arcuate in form with the top portion being scalloped so as to assist in retention of bracelets on top of the bars. Like the clip earring accessory assembly, the bracelet bar accessory assembly 30 includes a support bracket 31 having extended portion 32 affixed to the rear of the bracelet bar 30 and a vertical portion 33 which extends through any of the openings 13 and when in place presses against the rear of the base board 10.

In a similar manner an accessory assembly 40 especially designed with a plurality of small openings 44 therein is especially designed for earrings intended for use with pierced ears, to be placed through the openings with the normal holders associated therewith placed on the rear to retain the earrings in proper place. Each of the pierced earring bars 40 are also equipped with a mounting bracket 41 having portions similar to those previously discussed at the front, 42 and the rear 43 utilized in a manner similar to that described for the other accessory assemblies.

A still further accessory assembly is that of a necklace bar 50 having scalloped top and bottom edges but being arcuate in form and essentially rectangular as shown in the drawings. The necklace bars 50 have two support brackets 51 designed to go through openings 13. Each bracket 51 also includes a front portion 52 and a rear section 53 adapted to function in a manner similar to that described for the other accessory units.

Figure 6:
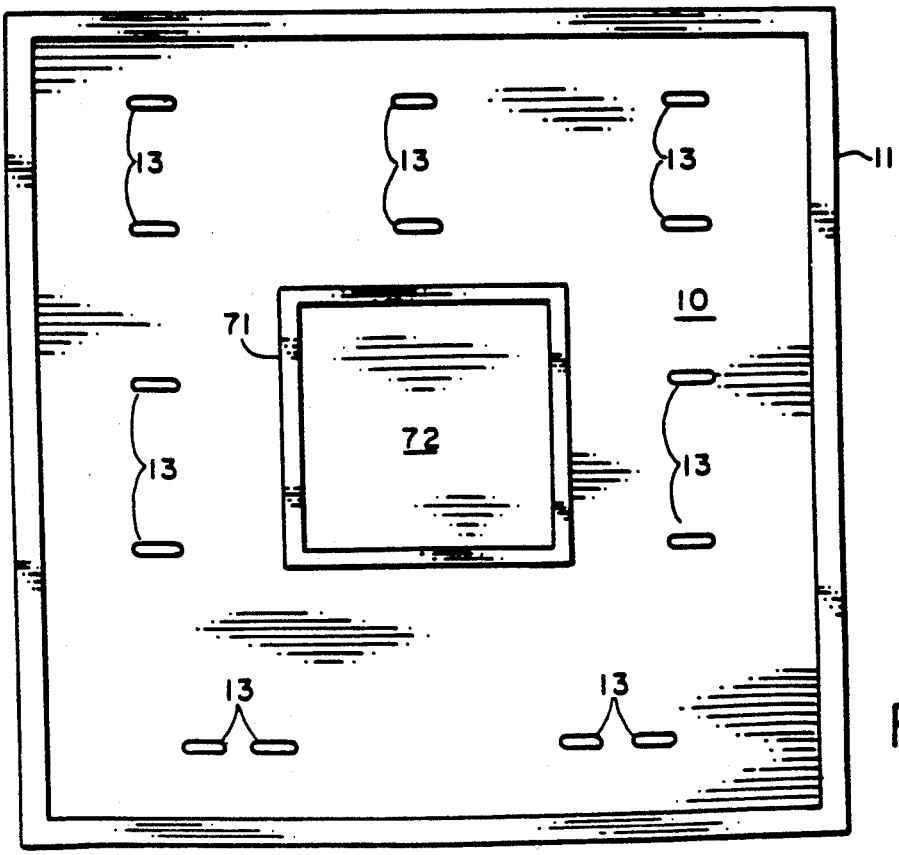
FIG. 6 is a front view of the base board used in the jewelry board of the present invention.

As can be seen by reference to FIGS. 3 and 6, the mounting board 10 has a recessed area 72 in the center thereof adapted to receive pin pad 70. This pin pad which fits within the recess 72 and has a preformed molding 71 around it, is intended for the receipt of pins, brooches or other sharp pointed elements that can be placed into pad 70 which consists of thermoform plastic or similar material. For example, pin pad 70 could also be made of cork, of a flocked paper covering a corrugated board element or any number of other soft materials which still maintain satisfactory structural stability so as to retain items pushed therein. While the pin pad 70 is shown as essentially square with the integral frame 71 surrounding it, it will be obvious it is not necessary to have a frame and furthermore that the shape may not necessarily be limited to that of a square only. Clearly other shapes such as round, oval, oblong, heartshape, etc., could all be utilized depending upon the decorative preference of users.

Also attached to the base board 10 by means of epoxy or other cementlike material is a trough shaped ring shelf 60 having an insert therein also of a foamlike plastic or similar material, adapted for the storage of finger rings which may be placed in the included spaced apart slots 63 which are included in the foam portion. Similar materials other than foam also could be utilized for this purpose, including rubber, cork, etc. A fabric covering might enhance the appearance, but is not necessary for practice of the present invention.

Figure 4:
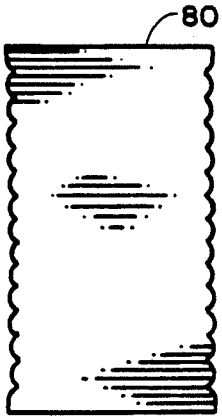
FIG. 4 is a front view of a barrette holder for use with a jewelry board in accordance with the present invention.
Figure 5:
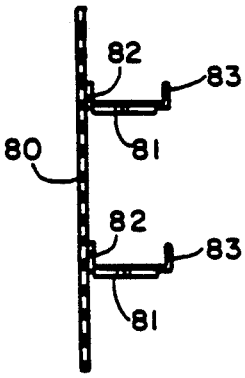
FIG. 5 is a side view of a barrette holder for use with a jewelry board in accordance with the present invention.

Reference is also made to FIGS. 4 and 5 wherein a special holder to support barrettes as frequently utilized by small girls, is shown as item 80. This device by virtue of its rectangular configuration with vertical scalloped edges is particularly adapted for barrettes to be placed thereon. It is similar in other respects to the previous accessory assemblies described but has two mounting brackets, like 81, attached to the rear thereof, each having front support portions 81 and rear support portions 83, to facilitate the barrette holder being placed within two of the openings 13 on base 10. A plurality of raised ribs such as those shown as 84 extend horizontally across the face of the barrette holder 80, to support and separate barrettes stored thereon.

It should be obvious from the foregoing that many different arrangements of accessory assemblies and in any quantities desired by the user could be effected depending upon the jewelry requirements and desires of its user.

It will be obvious from the foregoing that numerous modifications can be made of the present invention without departing from the spirit of the invention which shall be limited only by the scope of the claims appended hereto.

What is claimed is:

1. An apparatus for holding and displaying jewelry, said apparatus comprising:

a substantially flat, rigid base, including a front surface, a back surface and a plurality of spaced apart openings;

a panel, including a layer of material capable of being easily penetrated by a pin, for retaining and displaying said pin, said panel located in said front surface;

a shelf projecting from said front surface, including a unitary slotted, resilient insert adapted to receive finger rings in said slots; and a plurality of interchangeable jewelry holding means, said holding means including a plurality of differing configurations, each of said interchangeable jewelry holding means further including one of said mounting means receivable within any of said openings so as to facilitate the selective placement of said interchangeable jewelry holding means in any position on said base so as to allow rapid variation of the display of said jewelry, said mounting means comprising a horizontal section extending from said jewelry holding means and a vertical section at the distal end of said horizontal section, said horizontal section being sized for insertion through one of said openings, said vertical section being sized and positioned for abutment against the rear of said base when said horizontal section is positioned through one of said openings, thereby retaining said jewelry holding means thereon.

2. A board for holding and displaying jewelry as claimed in claim 1 wherein:

said base includes a recessed area adapted to receive said layer of material capable of being penetrated by a pin, for retaining and displaying said pin.

3. A board for holding and displaying jewelry as claimed in claim 1 wherein:

said layer of material capable of being easily penetrated by a pin and retaining and displaying said pin comprises a plastic foamlike material.

4. A board for holding and displaying jewelry as claimed in claim 1 wherein:

said unitary slotted resilient insert adapted to receive finger rings, comprises a plastic foamlike material.

5. A board for holding and displaying jewelry as claimed in claim 1 wherein:

at least one of said jewelry holding means is adapted to support a plurality of pierced ear type of earrings.

6. A board for holding and displaying jewelry as claimed in claim 5 wherein:

said jewelry holding means adapted to support pierced ear type of earrings includes a plurality of apertures defined therein through which apertures the attachment means, such as posts of pierced earrings, can be passed, and from the rear thereof, the rear clips of such pierced ear earrings can be inserted on said earring posts to hold said jewelry to said jewelry holding means, said apertures each being of a size smaller than the rear clips.

7. A board for holding and displaying jewelry as claimed in claim 1 wherein:

at least one of said plurality of jewelry holding means is adapted to hold and display earrings equipped with an ear lobe catch element.

8. A board for holding and displaying jewelry as claimed in claim 7, wherein:

said jewelry holding means adapted to support earrings equipped with ear lobe catch elements includes a plurality of sections each adapted to receive a plurality of said earrings equipped with catch elements in a retaining arrangement.

9. A board for holding and displaying jewelry as claimed in claim 1 wherein:

at least one of said jewelry holding means is adapted to support a plurality of bracelets thereon.

10. A board for holding and displaying jewelry as claimed in claim 9 wherein:

said jewelry holding means adapted to support a plurality of bracelets thereon includes an upper edge thereof in scalloped configuration so as to provide gripping means for the retention of said bracelets.

11. A board for holding and displaying jewelry as claimed in claim 1 wherein:

at least one of said jewelry holding means is adapted to support and display a plurality of necklaces thereon.

12. A board for holding and displaying jewelry as claimed in claim 11 wherein:

said jewelry holding means adapted to support a plurality of necklaces thereon includes an upper scalloped surface and a lower scalloped surface adapted to assist in the retention of necklaces on said jewelry holding means.

13. A board for holding and displaying jewelry as claimed in claim 1 wherein:

at least one of said plurality of jewelry holding means is adapted to support and display a plurality of hair barrettes.

14. A board for holding and displaying jewelry as claimed in claim 13 wherein:

said jewelry holding means adapted to support a plurality of hair barrettes, comprises a rectangular element with scalloped vertical edges, adapted to have a plurality of barrettes clasped around said element.

15. A board for holding and displaying jewelry as claimed in claim 14 wherein:

said rectangular element further includes a plurality of spaced apart ribs each extending horizontally across a front surface of said element.

16. A board for holding and displaying jewelry as claimed in claim 1 wherein:

said base is substantially rectangular in form.

17. A board for holding and displaying jewelry as claimed in claim 1 wherein:

there is further included a plurality of mounting means adapted to facilitate the mounting of said board on a vertical surface.

18. A board for holding and displaying jewelry as claimed in claim 17 wherein:

said mounting means comprise a plurality of T-slot mounting brackets affixed to the back surface of said base.

* * * * *